United States Patent [19]

Leblanc

[11] 4,233,707

[45] Nov. 18, 1980

[54] FOOTWEAR CLEANING APPARATUS

[76] Inventor: Gilles Leblanc, 2152 Montee des 4 Lacs, St. Adolphe D'Howard, Montreal P. Q. JOT 2B0, Canada

[21] Appl. No.: 55,527

[22] Filed: Jul. 9, 1979

[51] Int. Cl.[3] ..... A47L 5/22

[52] U.S. Cl. ..... 15/311; 15/34; 15/346

[58] Field of Search ..... 15/310, 311, 34, 36, 15/346

[56] References Cited

U.S. PATENT DOCUMENTS

| | | | |
|---|---|---|---|
| 1,361,068 | 12/1920 | Karro | 15/311 |
| 2,895,159 | 7/1959 | Ostrow | 15/311 |
| 2,953,805 | 9/1960 | Sevenich | 15/310 |
| 3,064,298 | 11/1962 | Jones | 15/310 |
| 3,445,875 | 5/1969 | Bohannon | 15/36 |
| 3,737,942 | 6/1973 | Casey | 15/311 X |
| 3,802,021 | 4/1974 | Schulz | 15/36 |
| 3,940,820 | 3/1976 | Smolka | 15/36 |
| 4,014,060 | 3/1977 | Taylor | 15/36 |
| 4,024,599 | 5/1977 | Gamboa | 15/311 |
| 4,118,818 | 10/1978 | Holleran | 15/36 |

*Primary Examiner*—Christopher K. Moore

*Attorney, Agent, or Firm*—Poms, Smith, Lande & Rose

[57] ABSTRACT

An apparatus cleans footwear with a closed system utilizing brushes and with recirculating compressed air. The apparatus has a housing and a cover containing a grill mounted to the housing by springs. Beneath the grill are a pair of cylindrical brushes which are rotated by electric motors in a direction toward the center of the grill. A combined vacuum cleaner and air compressor beneath the grill provides both a source of compressed air to help clean the shoes and suction to collect the dirt and any other debris dislodged by the apparatus. The brushes clean the bottoms of the shoes and direct any dislodged dirt and other debris toward the center area of the grill. A pair of air tubes disposed along the edges of the grill direct the compressed air over the shoes and toward the center of the grill, along with any debris dislodged thereby. Beneath the center of the grill is a removable collection tank having a slot facing the grill and having an open end connected by a filter to the intake of the air compressor. The air compressor draws air into the tank through the slot and draws any debris in the collection area into the tank. The debris is removed from the air by the filter and the filtered air is then recompressed and recirculated via the air tubes over the top of the shoes.

6 Claims, 3 Drawing Figures

FOOTWEAR CLEANING APPARATUS

FIELD OF THE INVENTION

The present invention relates to footwear cleaning apparatus, and in particular to apparatus cleaning footwear by a combination of brushing and circulating air.

BACKGROUND OF THE INVENTION

Many power-driven apparatus have been devised to clean footwear such as boots and shoes. Most of these devices, such as those disclosed in U.S. Pat. Nos. 3,802,021 (Schulz), 3,940,820 (Smolka), 4,014,060 (Taylor) and 4,118,818 (Holleran), clean only the bottoms of shoes, and do so by the placing of a rotary brush against the shoe sole when a shoe is placed upon the device.

Other devices, such as those disclosed in U.S. Pat. Nos. 3,445,875 (Bohannon), and 4,024,599 (Gamboa), have used a vacuum means in conjunction with the rotary brushes to collect the dirt and other debris dislodged from the shoes by the brushes. However, the vast majority of the shoe cleaning devices found in the prior art do not incorporate provisions for cleaning the upper portion of a shoe. Finally, most of the devices found in the prior art are complicated mechanical devices and are rather cumbersome to transport.

A footwear cleaning apparatus which would clean both the upper and lower portions of shoes and yet which would be simple mechanically and easily transportable would be of great use in both personal and industrial applications. Such a device would be especially attractive in areas having severe weather, as it would allow a complete cleaning of one's shoes prior to entering a home or office, and thus would prevent the soiling of any carpets therein.

Accordingly, it is the principal object of this invention to efficiently clean the upper and lower portions of footwear such as shoes.

It is an additional object of this invention to completely collect any debris which is dislodged from the footwear during the cleaning process.

It is still another object of this invention to simplify the mechanisms presently used for cleaning shoes.

It is a final object of this invention to enhance the portability of devices utilized to clean footwear.

SUMMARY OF THE INVENTION

The present invention, in a broad aspect, provides an apparatus for cleaning and collecting dirt and other debris from a pair of articles of footwear, such as shoes, boots, etc.. The cleaning and collecting is done by a combination of brushing and recirculating compressed air. Power brushes brush debris from the lower sides of the shoes in a manner directing the debris toward a collection area. An air compressor blows debris from the upper sides of the shoes by compressed air in a manner which directs the debris toward the collection area. The air compressor collects all of the debris directed toward the air compressor by recirculating the compressed air. The collected debris in the recirculated air is stored in the apparatus by filtering the recirculated air prior to its entering the air compressor. Accordingly, a closed system for cleaning footwear is provided wherein recirculated compressed air is used to both clean debris from shoes, in combination with power brushes, and also to collect the debris.

The dual functioning of the air compressor in both cleaning and collecting dirt and other debris from the shoes achieves a novel and synergistic result. Other shoe cleaning apparatus, as discussed, rarely have utilized any means to collect the debris dislodged from the shoes. Those which have utilized such means have done so with a discrete vacuum-cleaning device. The dual functioning of the air compressor not only overcomes the problem of collecting the dislodged debris, but does so in a manner which does not necessitate a separate vacuum-cleaning element. In view of the prior art, this dual functionality is both surprising and unexpected and is properly considered synergistic.

In accordance with one feature of the invention, the apparatus includes an open housing and a grill disposed within the housing. The grill is of a size to accommodate a pair of shoes and has a plurality of slots in it disposed normal to an axis parallel to the sides of the shoes. Springs support the grill on the housing and allow the grill to move downwardly when a pair of shoes is placed on it. A switch connected to the grill into the housing initiates the cleaning of the shoes when the downward movement of the grill occurs.

In accordance with still another feature of the invention, the bottoms of the pair of shoes are cleaned by a pair of cylindrical brushes. Each brush is of a length slightly larger than the shoes to be cleaned and is journaled in horizontal disposition within the housing beneath the grill for rotation toward the collection area. The brushes contact the shoes through the grill slots upon the downward movement of the grill. The brushes are rotated by electric motors in the housing connected to the switch.

In accordance with still another feature of the invention, an air compressor provides a source of compressed air to clean the upper sides of the shoes. A pair of air tubes connected to the compressor is disposed along the outer edge of the grill and direct a plurality of streams of compressed air across the upper sides of the shoes. The streams dislodge any debris on the upper sides of the shoes and direct the debris toward the collection area. An air intake, connected to the compressor and disposed beneath the collection area allow the streams of compressed air to be drawn back into the air compressor. As the drawing of air is done through the collection area, the debris dislodged from the shoes is circulated into the apparatus and toward the air compressor. Accordingly, all the debris dislodged from the shoes is collected by the apparatus.

In accordance with still another feature of the invention, the debris dislodged from the shoes and present in the air circulating through the air intake is collected in a storage tank prior to the recirculated air entering the compressor. The storage tank is removably disposed beneath the collection area and includes a slot adjacent the collection area. The tank is open at one end and the air compressor connects to the open end. A filter element, disposed between the open end of the tank and the air compressor, filters the debris from the recirculated air entering the air compressor. Accordingly, all of the debris dislodged by the brushes and by the streams of compressed air is collected in the storage tank. As the storage tank is removable from the apparatus, the collected debris may be easily disposed of once the shoes have been cleaned.

Other objects, features and advantages of the present invention will become apparent from a consideration of the following detailed description and from the accompanying drawings.

DETAILED DESCRIPTION

Figure 1:
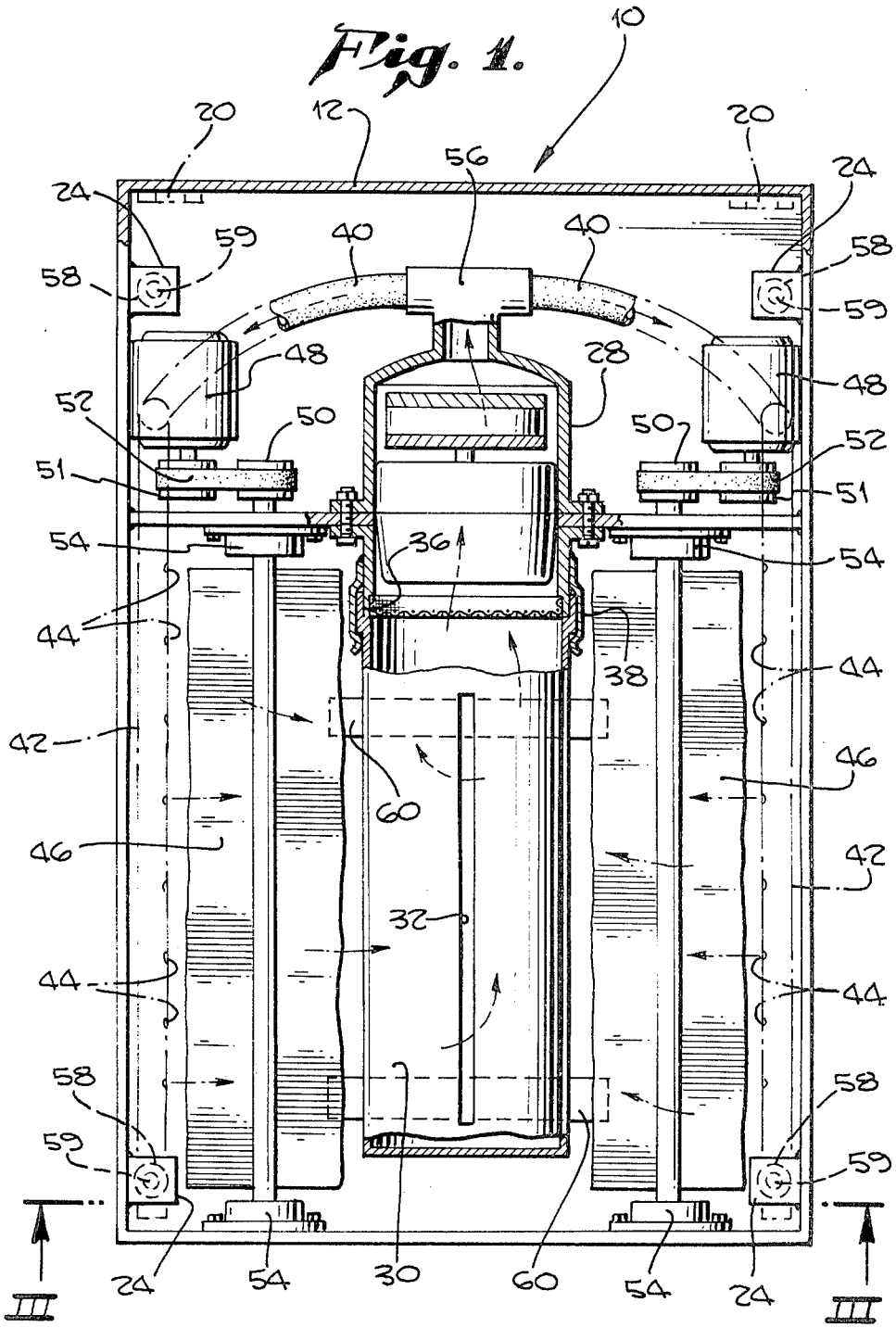
FIG. 1 shows a top view of a footwear cleaning apparatus embodying the principles of the present invention, said view showing the grill portion of the apparatus removed from the housing portion.

Referring more particularly to the drawings, FIG. 1 shows a footwear cleaning apparatus, generally denoted 10, illustrating the principles of the present invention. The apparatus 10 cleans a pair of articles footwear, such as boots or shoes placed atop it by brushing the lower sides of the shoes and by passing compressed air over the upper sides of the shoes. The direction of the air and the brushing is oriented to direct any debris dislodged from the shoes toward a collection area in the central portion of the apparatus. The dislodged debris is then directed into the apparatus by a recirculation of the compressed air. In this manner, a closed system is formed by the action of dislodging of debris by the brushes and by the compressed air in conjunction with the reuse of the compressed air to collect the dislodged debris.

Figure 2:
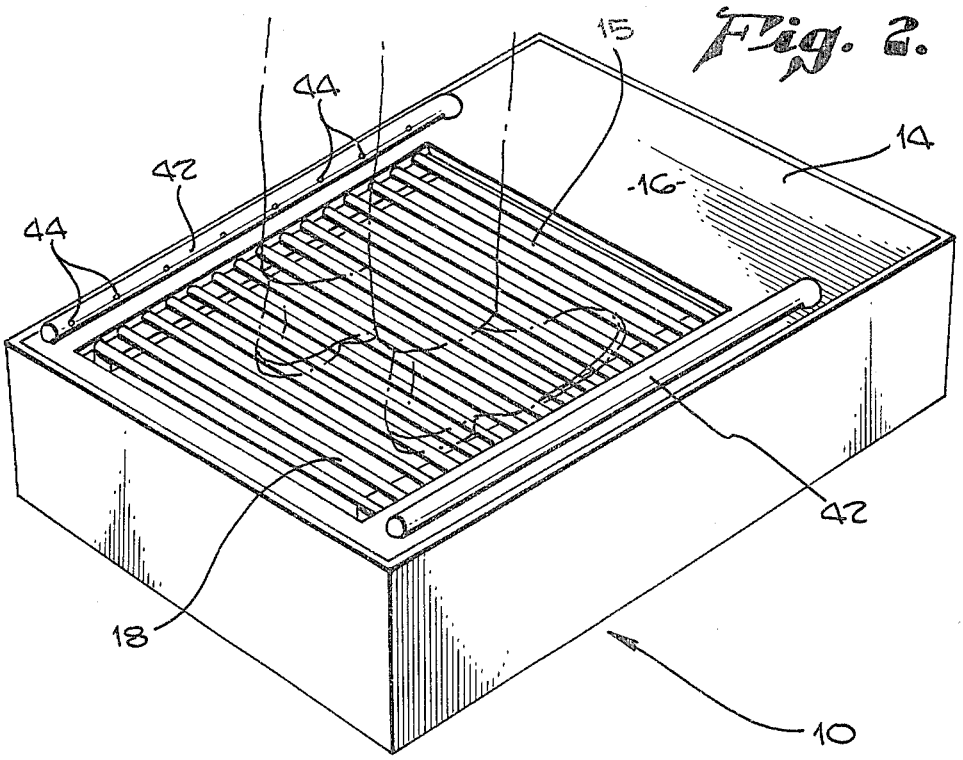
FIG. 2 shows a top view of the grill portion of the apparatus.

As is seen in FIGS. 1 and 2, the apparatus 10 includes a housing 12, and a housing cover 14. The housing cover 14 has a slotted area 18 at one end forming a grill, and a solid area 16 at the other end. The slots in the grill portion 15 of the housing cover 14 are disposed normal to an axis parallel with the sides of the apparatus. A pair of shoes or boots placed on the apparatus for cleaning are oriented perpendicular to the grill portion 18 of the housing cover 14.

Figure 3:
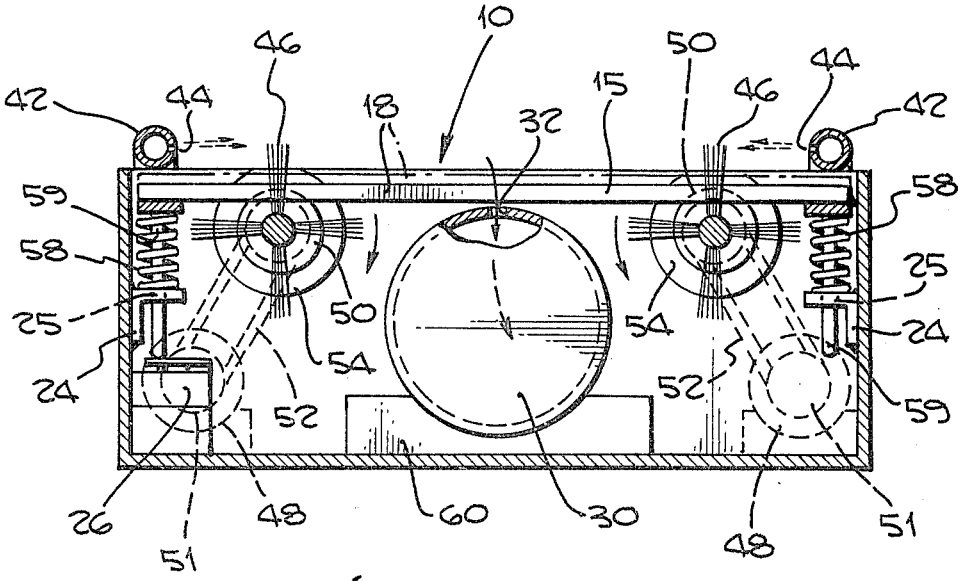
FIG. 3 shows a cross-sectional view of the of the apparatus.

The housing cover 14 is supported on the housing 12 by an angle bracket 24 located at each corner of the housing 12. As is seen in FIG. 3, each angle bracket 24 is disposed slightly beneath the upper edge of the housing 12. Onto each angle bracket 24 is affixed a spring member 58. Each of the spring members is attached to its respective angle bracket by means of a bolt 59 which passes through the spring 58 and through a hole 25 in the angle bracket 24 in a manner allowing the bolt 59 to travel downwardly through the angle bracket 29.

Each corner of the housing cover 14 is positioned atop one of the bolts at one corner of the housing 12. Accordingly, the springs 58 bias the housing cover 14 upward when no force is exerted upon it. However, when one steps onto the housing cover 14, or when a pair of shoes is placed onto the housing cover 14, the cover is moved downwardly as the weight on the grill causes the downward movement of the bolts and the resulting compression of the springs 58. One of the bolts 58 forms part of a switch 26 which energizes the apparatus 10 when weight is placed upon the housing cover 14. This switch 26 supplies electric power to the portions of the apparatus to which do the brushing and the generation of compressed air.

The housing cover 14 is shown attached to the housing 12 by a hinge member 20. Alternatively, the housing cover 20 may be simply positioned upon the bolts 59 passing through the springs 58. When a hinge member 20 is utilized, the springs 58 may be designed to bias the end of the housing cover unattached to the hinge 20 slightly upward relative to the attached end, so that when a pair of shoes are placed upon the apparatus 10 for cleaning the housing cover 14 assumes an level orientation.

Regarding the cleaning of the bottoms of the shoes by brushing, the interior of the housing 12 has two brushes 46 journaled on bearings 54 within the housing for rotation about their longitudinal axes. Each brush is substantially cylindrical throughout its length and is rotated about its central axis by an electric motor 48. Each motor 48 is connected to its corresponding brush 46 by a drive belt 52 connected between a motor pulley 51 and a brush pulley 50. Each motor 48 is connected to the switch 26 and is energized when pressure is placed upon the housing cover 14. Each motor 48 rotates its corresponding brush 46 toward the center of the housing cover 14.

When the shoe cleaning apparatus 10 is used to clean a pair of shoes, one shoe is placed on the housing cover 14 above each of the brushes 46. The bristles of the brush 46 come in contact with the shoes upon the downward movement of the housing cover which occurs when any weight is placed upon the cover. Accordingly, the bristles of the brush extend through the grill portion 18 and contact the bottoms of the shoes. This orientation of the bristles and the direction of rotation of the brushes 46 causes any dirt dislodged from the bottom of the shoes to be directed toward the center of the grill portion 18 of the housing cover 14.

Regarding the cleaning of the upper portions of a pair of shoes by compressed air, an air compressor 28 is mounted within the housing 12. The air compressor 28 directs compressed air through a pair of flexible air hoses 40 to a pair of air tubes 42 attached to the upper surface of the housing cover 14. Each of the flexible air tubes 40 connects to a T-shaped coupling 56 attached to the outlet of the air compressor 28. The flexible air tubes 40 are utilized to allow the removal of the housing cover 14 without the necessity of having to disconnect any of the internal components.

Each of these tubes 42 have a plurality of air holes 44 disposed along its entire length and directed toward the center of the housing cover 14. In this manner, any debris on the upper surface of the shoes is dislodged and directed toward the center of the grill 18. One end of each tube is sealed so as to force air out the holes 44. The air compressor 28 is energized when weight is applied to the housing cover 14. Energizing the compressor causes the generation of pressurized air, and thus the direction of the pressurized air through the holes 44 in the air tubes 42.

The intake port for the air compressor 28 is connected to a removable tank 30 disposed centrally beneath the grill portion 18 of the housing cover 14 and supported in the housing by a pair of tank supports 60. One end of the tank 30 is open and is lockingly abutted to the intake of the air compressor 28 by a strap 38. A filter 34 is provided in the open end 36 of the tank 30 adjacent the compressor. Cut into one side of the tank 30 and disposed adjacent to the grill 18 an slot 32. It is through this slot 32 that the air compressor 28 draws air for compression and for subsequent direction to the air tubes 42 on the upper surface of the housing cover 14. Accordingly, a vacuum or suction force is created at the slot 32 which causes the drawing of debris into the tank 30. Thus, the slot 32 and inner areas of the tank 30 function as an air intake for the compressor 28.

The filter 34 prevents any of the debris in the recirculating air from entering the air compressor 28. The apparatus 10 may thus be utilized to clean footwear until the collection tank 30 is filled with debris, whereupon the tank 30 is disconnected from the air compressor 28 by means of the strap 38 and removed from the housing 12, thus allowing the debris to be emptied from the tank 30.

It is thus seen that the cleaning of a pair of shoes or other articles of the footwear placed upon the apparatus is done by the combination of the compressed air and the rotary brushes dislodging debris from the shoes and directing the debris toward the center of the grill 18 and the recirculation of the compressed air through the tank 30. The recirculation draws the debris into the tank 30 and the debris is filtered from the recirculated air prior to recompression. Thus, the compressed air directed against the shoes is the same air which initially contains the debris dislodged from these shoes and which has been subsequently filtered prior to compression. Such a closed system is very efficient, simple to maintain, and has no counterpart in the prior art.

In a prototype version of the apparatus, the housing was approximately 20 inches wide, by 30 inches long, by 8 inches deep. Standard 120-volt electric motors were used to turn the rotary brushes. Also, the air compressor motor used was very similar to that found in vacuum cleaners. Corregated plastic tubing was used to route the compressed air to the air tubes mounted atop the grill, which were themselves constructed of lightweight piping. Accordingly, a simple, lightweight, efficient, and easily-transportable mechanism for cleaning shoes was achieved.

As this apparatus is designed for both home and industrial use, the various components of the apparatus may be constructed of heavy-duty material to insure reliable operation under a variety of conditions. Also, the springs which support the housing cover may be varied in strength to allow either the cleaning of a pair of shoes when only the shoes themselves are placed upon the apparatus, or to allow the cleaning of the shoes when the shoe wearer steps upon the apparatus.

In the foregoing description of the present invention, a preferred embodiment of the invention has been disclosed. It is to be understood that other mechanical and designed variations are within the scope of the present invention. Thus, by way of example and not of limitation, a different arrangement of the grill slots in the housing cover could be utilized; the rotary brushes could be shaped differently than described; different means could be utilized to activate the apparatus when a pair of shoes is placed upon it; separate sources of compressed air and suction could be utilized; and the air tubes on the top of the housing cover could be oriented differently than as shown. Accordingly, the invention is not limited to the particular arrangement which has been illustrated and described in detail.

What is claimed is:

1. A footwear cleaning apparatus for cleaning and collecting debris from a pair of articles of footwear such as shoes by a combination of brushing and recirculating compressed air, comprising:

power brush means for brushing debris from the lower sides of said shoes in a manner directing said debris toward a collection area;

air compressor means for blowing the debris from the upper sides of said shoes by compressed air in a manner directing said debris toward said collection area, and for collecting all aforesaid debris by recirculating said compressed air through said collection area;

storage tank means for storing said collected debris, said tank means removably disposed beneath said collection area, connected to said compressor means, and including a slot beneath said collection area; and a filter element disposed between said tank means and said compressor means, whereby said compressor means continually recirculates said compressed air through said collection area and said tank means, said filter element collecting any debris from said recirculating air within said tank means.

2. A footwear cleaning apparatus for cleaning and collecting debris from a pair of articles of footwear such as shoes by a combination of brushing and recirculating compressed air, comprising:

(a) an open housing;

(b) a grill disposed within said housing and of a size to accommodate a pair of shoes, said grill including a plurality of slots disposed normal to an axis parallel with the sides of said shoes, and having a collection area defined by the central portion of said grill;

(c) spring means for supporting said grill on said housing, said spring means allowing downward movement of said grill when a person steps upon said grill;

(d) switch means, mounted to said grill and to said housing, for initiating the cleaning of said shoes upon said downward movement of said grill;

(e) power brush means for brushing debris from the lower sides of said shoes in a manner directing said debris toward said collection area, said brush means comprising:

(i) first brush means, substantially cylindrical in shape and of a length slightly larger than a shoe to be cleaned, for cleaning the bottom of one of said pair of shoes, said brush means being journaled in horizontal disposition in said housing beneath said grill for rotation toward said collection area, and said brush means contacting said shoe through said grill slots upon said downward movement of said grill, (ii) first motor means, connected to said switch means, for rotating said brush means upon said downward movement of said grill, (iii) second brush means, substantially identical to said first brush means, for cleaning the bottom of the other of said pair of shoes placed upon said grill, and (iv) second motor means, connected to said switch means, for rotating said second brush means;

(f) air compressor means for blowing the debris from the upper sides of said shoes by compressed air in a manner directing said debris toward said collection area, and for collecting all aforesaid debris by recirculating said compressed air through said collection area, said air compressor means comprising:

(i) an air compressor connected to said switch means and supplying compressed air, (ii) a pair of air hoses, connected between said air compressor and said grill for directing compressed air to said grill, (iii) a pair of air tube means, connected to said air hoses and disposed along the outer edges of said grill, for directing a plurality of streams of compressed air across said upper sides of said shoes toward said collection area, said streams dislodging said debris on said upper sides of said shoes and directing said debris toward said collection area, and (iv) air intake means, disposed beneath said collection area and connected to said compressor, for allowing said streams of compressed air to be drawn through said grill into said air compressor, said recirculated air carrying all aforesaid debris toward said compressor from said collection area;

(g) means for filtering said collected debris from said recirculated compressed air for storing said collected debris, said filtering and storing means comprising:

(i) a generally cylindrical tank removably disposed beneath said grill, said tank including a slot disposed directly beneath said collection area, said tank being open at one end and connected to said air compressor at said open end, and (ii) a filter element disposed across said open end of said tank, whereby debris in said collection area is drawn into said tank through said slot as said compressor recirculates said compressed air in said collection area through said tank, said filter element preventing said debris from entering said compressor and collecting said debris in said tank.

3. An apparatus for cleaning footwear such as shoes, comprising:

(a) an open housing;

(b) a grill disposed within said housing and of a size to accommodate a pair of shoes, said grill including a plurality of slots disposed normal to an axis parallel with the sides of said shoes, and said grill having a central collection area for dirt and debris removed from said shoes;

(c) spring means for supporting said grill on said housing, said spring means allowing downward movement of said grill when a pair of shoes is placed upon said grill;

(d) switch means, mounted to said grill and to said housing, for initiating the cleaning of said shoes upon said downward movement of said grill;

(e) brush means for mechanically removing dirt and debris from said shoes; and (f) recirculating air compressor means for both removing dirt and debris from said shoes and for collecting and storing all dirt and debris removed from said shoes, said recirculating air compressor means comprising:

(i) an air compressor connected to said switch means and supplying air under pressure upon said downward movement of said grill, (ii) a pair of air hose means, connected to said compressor, for directing said compressed air to said grill, (iii) a pair of air tube means, connected to said hose means and disposed along the outer edges of said pair of shoes placed upon said grill, for directing a plurality of streams of compressed air across said upper sides of said shoes, said streams dislodging said debris on said upper sides of said shoes and directing said debris toward said collection area, and (iv) cylindrical storage tank means, disposed within said housing beneath said collection area of said grill, having a slot defined longitudinally in its side beneath the collection area, and having one end open and connected to said air compressor, for storing said debris and for providing an air intake for said compressor means, and (v) filter means, disposed across said open end of said storage tank means, for moving debris from air entering said tank through said slot beneath said collection area, whereby said compressed air from said compressor is circulated through said collection area and into said tank for recompression, said circulation creating a vacuum at said collection area causing said debris thereat to be drawn into said tank along with said air, said debris being then filtered from said recirculated air by said filter means.

4. An apparatus for cleaning footwear such as shoes, comprising:

(a) an open housing;

(b) a grill disposed within said housing and being of a size to accommodate a pair of shoes, said grill including a plurality of slots disposed normal to an axis parallel with the sides of said shoes, and said grill having a central collection area for dirt and debris removed from said shoes;

(c) spring means for supporting said grill on said housing, said spring means allowing downward movement of said grill when a pair of shoes is placed upon said grill;

(d) switch means, mounted to said grill and to said housing, for initiating the cleaning of said shoes upon said downward movement of said grill;

(e) brush means for mechanically removing dirt and debris from said shoes; and (f) recirculating air compressor means for both removing dirt and debris from said shoes and for collecting and storing all dirt and debris removed from said shoes, said recirculating air compressor means comprising:

(i) an air compressor connected to said switch means and supplying air under pressure upon said downward movement of said grill, (ii) a pair of air hose means, connected to said compressor, for directing said compressed air to said grill, (iii) a pair of air tube means, connected to said hose means and disposed along the outer edges of said pair of shoes placed upon said grill, for directing a plurality of streams of compressed air across said upper sides of said shoes, said streams disloding said debris on said upper sides of said shoes and directing said debris toward said collection area, (iv) cylindrical storage tank means, disposed within said housing beneath said collection area of said grill, having a slot defined longitudinally in its side beneath the collection area, and having one end open and connected to said air compressor, for storing said debris and for providing an air intake for said compressor means, said storage tank means being removably attached to said housing, thereby allowing removal of said storage tank means to dispose of said collected debris, and (v) filter means, disposed across said open of said storage tank means, for moving debris from air entering said tank through said slot beneath said collection area, whereby said compressed air from said compressor is circulated through said collection area and into said tank for recompression, said circulation creating a vacuum at said collection area causing said debris thereat to be drawn into said tank along with said air, said debris being then filtered from said recirculated air by said filter means.

5. A footwear cleaning apparatus for cleaning and collecting debris from a pair of articles of footwear such as shoes by a combination of brushing and recirculating compressed air, comprising:

power brush means for brushing debris from the lower sides of said shoes in a manner directing said debris toward a collection area;

air compressor means for blowing the debris from the upper sides of said shoes by compressed air in a manner directing said debris toward said collection area, and for collecting all aforesaid debris by recirculating said compressed air through said collection area;

storage tank means for storing said collected debris, said tank means removably disposed beneath said collection area, connected to said compressor means, and including collection opening means, beneath said collection area, for allowing said debris directed toward said collection area by said air compressor means to enter said tank means; and a filter element disposed between said tank means and said compressor means, whereby said compressor means continually recirculates said compressed air through said collection area and said tank means, said filter element collecting any debris from said recirculating air within said tank means.

6. A footwear cleaning apparatus as defined in claim 5, wherein said air compressor means includes a pair of air tube means for directing a plurality of streams of compressed air across said upper sides of said shoes toward said collection area, said stream dislodging said debris on said upper sides of said shoes and directing said debris toward said collection area.

* * * * *